US008444427B2

(12) United States Patent
Hashimoto

(10) Patent No.: US 8,444,427 B2
(45) Date of Patent: May 21, 2013

(54) ELECTRICAL CONNECTOR

(75) Inventor: Yoshimitsu Hashimoto, Tokyo (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 13/217,077

(22) Filed: Aug. 24, 2011

(65) Prior Publication Data

US 2012/0064749 A1 Mar. 15, 2012

(30) Foreign Application Priority Data

Sep. 9, 2010 (JP) ..... 2010-201524

(51) Int. Cl.
*H01R 13/62* (2006.01)

(52) U.S. Cl.
USPC ..... 439/325

(58) Field of Classification Search
USPC ..... 439/325–328
See application file for complete search history.

(56) References Cited

U.S. PATENT DOCUMENTS 3,803,533 A * 4/1974 Taplin ..... 439/328
4,008,942 A * 2/1977 Grossi ..... 439/328
4,995,825 A * 2/1991 Korsunsky et al. ..... 439/328
5,094,624 A * 3/1992 Bakke et al. ..... 439/326
5,112,242 A * 5/1992 Choy et al. ..... 439/326
5,123,857 A * 6/1992 Lee Chao ..... 439/326
5,154,627 A * 10/1992 Lee ..... 439/326
5,169,333 A * 12/1992 Yang Lee ..... 439/326
5,174,780 A * 12/1992 Yang Lee ..... 439/326
5,203,714 A * 4/1993 Tuan ..... 439/326
5,209,675 A * 5/1993 Korsunsky ..... 439/326
5,244,403 A * 9/1993 Smith et al. ..... 439/326
5,273,451 A * 12/1993 Lin ..... 439/326
5,286,217 A * 2/1994 Liu et al. ..... 439/326
5,372,518 A * 12/1994 Liu et al. ..... 439/326
5,374,203 A * 12/1994 Sato et al. ..... 439/326
5,395,262 A * 3/1995 Lwee ..... 439/326
5,413,496 A * 5/1995 Yu ..... 439/326
5,516,304 A * 5/1996 Yu ..... 439/326
5,647,755 A * 7/1997 Hida et al. ..... 439/328
5,649,831 A * 7/1997 Townsend ..... 439/157
5,660,557 A * 8/1997 Lemke et al. ..... 439/328
5,730,614 A * 3/1998 Yu ..... 439/326

(Continued)

FOREIGN PATENT DOCUMENTS

JP 2001-196130 A 7/2001

*Primary Examiner* — Ross Gushi
(74) *Attorney, Agent, or Firm* — Studebaker & Brackett PC; Donald R. Studebaker

(57) ABSTRACT

An electrical connector including a housing having first and second portions opposite to each other and provided on the second portion with an opening through which a flat circuit device is inserted in the housing along a direction extending toward the first portion and a mounting member fixed to the housing, wherein the mounting member comprises a base portion, a board connecting portion provided on the base portion to be connected with a solid circuit board which the first portion of the housing faces closely, an arm portion extending from the base portion into the housing, a locking portion provided on the arm portion for engaging with the flat circuit device inserted in the housing through the opening provided thereon to hold the same, and a manipulatable portion provided on the arm portion for protruding from the second portion of the housing to the outside of the housing, and the locking portion is operative to disengage from engagement with the flat circuit device when the manipulatable portion is manipulated under a condition wherein the locking portion is put in the engagement with the flat circuit device.

3 Claims, 10 Drawing Sheets

U.S. PATENT DOCUMENTS

| | | | | |
|---|---|---|---|---|
| 6,045,386 | A * | 4/2000 | Boe | 439/327 |
| 6,074,231 | A * | 6/2000 | Ju | 439/327 |
| 6,332,792 | B1 * | 12/2001 | Lin et al. | 439/160 |
| 6,379,168 | B1 * | 4/2002 | Wang | 439/160 |
| 6,672,888 | B1 * | 1/2004 | Ku | 439/153 |
| 6,824,413 | B1 * | 11/2004 | Shipe et al. | 439/326 |
| 6,960,093 | B1 * | 11/2005 | Fan | 439/326 |
| 7,004,773 | B1 * | 2/2006 | Poh et al. | 439/160 |
| 7,121,862 | B2 * | 10/2006 | Tang et al. | 439/327 |
| 7,234,971 | B2 * | 6/2007 | Chou et al. | 439/630 |
| 7,578,689 | B2 * | 8/2009 | Guan et al. | 439/327 |
| 7,666,011 | B2 * | 2/2010 | Lim et al. | 439/157 |
| 7,677,907 | B2 * | 3/2010 | Guan et al. | 439/157 |
| 7,988,480 | B2 * | 8/2011 | Yao et al. | 439/329 |
| 8,221,149 | B2 * | 7/2012 | Liu | 439/328 |
| 8,235,740 | B2 * | 8/2012 | Tsai | 439/328 |
| 8,251,728 | B2 * | 8/2012 | Zhu | 439/328 |
| 2002/0072264 | A1 * | 6/2002 | Yahiro et al. | 439/328 |
| 2003/0100211 | A1 * | 5/2003 | Wu | 439/328 |
| 2005/0009396 | A1 * | 1/2005 | Wu | 439/327 |
| 2008/0220642 | A1 * | 9/2008 | Guan et al. | 439/325 |
| 2009/0017666 | A1 * | 1/2009 | Lim et al. | 439/328 |
| 2011/0021053 | A1 * | 1/2011 | Li et al. | 439/327 |
| 2011/0045681 | A1 * | 2/2011 | Tsai | 439/328 |
| 2011/0104926 | A1 * | 5/2011 | Li et al. | 439/327 |
| 2011/0159718 | A1 * | 6/2011 | McKee | 439/326 |
| 2012/0064749 | A1 * | 3/2012 | Hashimoto | 439/329 |

* cited by examiner

ELECTRICAL CONNECTOR

BACKGROUND OF THE INVENTION

1. Field of the Invention

The present invention relates generally to an electrical connector, and more particularly to an improvement in an electrical connector which has a housing, in which a flat circuit device, such as a flexible printed circuit board (hereinafter, referred to as an FPC) or a flexible flat cable assembly (hereinafter, referred to as an FFC) is inserted, a plurality of conductive contacts arranged in the housing for coming into contact with connecting terminals provided on the flat circuit device inserted in the housing, so as to put the connecting terminals provided on the flat circuit device in electrical connection with a solid circuit board, and locking means for engaging with the flat circuit device inserted in the housing so as to hold the same to be prevented from getting out of the housing unwillingly.

2. Description of the Prior Art

A flat circuit device, such as a relatively small-sized FPC or FFC, used in electronic apparatus of various kinds is often connected electrically with a solid circuit board, on which various electrical parts are directly mounted, with an electrical connector which is fixed to and connected electrically with the solid circuit board. The electrical connector has a plurality of conductive contacts, an end portion of each of which is connected electrically with a conductive circuit pattern portion formed on the solid circuit board and which are provided for coming into contact with connecting terminals provided on the flat circuit device, and is operative to cause each of the connecting terminals provided on the flat circuit board to be electrically connected through the conductive contact with the conductive circuit pattern portion formed on the solid circuit board.

A previously proposed electrical connector thus used for connecting electrically a flat circuit device, such as an FPC, with a solid circuit board, is provided with a housing made of insulator, which is mounted on the solid circuit board and has an opening through which at least a part of the flat circuit device is inserted into the housing. In the housing, a plurality of conductive contacts are provided to be arranged along the opening and connected electrically with circuit terminals provided on the solid circuit board. These conductive contacts are operative to come into contact respectively with a plurality of connecting terminals provided on the flat circuit device when the flat circuit device is inserted into the housing through the opening provided thereon. With the conductive contacts of the electrical connector put in a condition for coming into contact with the connecting terminals on the flat circuit device, the flat circuit device is electrically connected with the solid circuit board.

The electrical connectors, each of which has the housing, in which the flat circuit device is inserted, are divided broadly into two types, one of which is the horizontal insertion type wherein the flat circuit device is inserted in the housing through the opening provided thereon along a direction substantially parallel to the solid circuit board on which the housing is mounted and the other of which is the vertical insertion type wherein the flat circuit device is inserted in the housing through the opening provided thereon along a direction substantially perpendicular to the solid circuit board on which the housing is mounted. The housing of each of the electrical connectors has a mounting outer surface portion which faces closely or comes into contact with the solid circuit board when the housing is mounted on the solid circuit board. In the electrical connector of the horizontal insertion type, the housing has the opening which is so provided that the flat circuit device is inserted in the housing through the opening along a direction substantially parallel to the mounting outer surface portion of the housing, and in the electrical connector of the vertical insertion type, the housing has the opening which is so provided that the flat circuit device is inserted in the housing through the opening along a direction substantially perpendicular to the mounting outer surface portion of the housing.

In the previously proposed electrical connector of either the horizontal insertion type or the vertical insertion type, when the flat circuit device is inserted in the housing through the opening provided thereon and the conductive contacts provided in the housing are put in press-contact with the connecting terminals provided on the flat circuit device so that the flat circuit device is put in electrical connection with the solid circuit board on which the housing is mounted, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts provided in the housing properly in a condition of press-contact with the connecting terminals provided on the flat circuit device.

Accordingly, regarding the electrical connectors of the vertical insertion type, there has been also proposed previously an electrical connector which is provided with a locking means for engaging with the flat circuit device inserted in the housing through the opening provided thereon along a direction perpendicular to the solid circuit board on which the housing is fixed so as to hold the same to be prevented from getting out of the housing unwillingly, as shown in, for example, the Japanese patent application published before examination under publication number 2001-196130 (hereinafter, referred to as published patent document 1).

In the electrical connector (a connector with a locking mechanism for an FPC/FFC) shown in the published patent document 1, a housing (an insulator 10) mounted on a solid circuit board (a board B) is provided with an opening (11) extending in a direction (a vertical direction) perpendicular to the solid circuit board, and a flat circuit device (a FPC/FFC 20) is inserted in the housing through the opening (11) along the direction perpendicular to the solid circuit board. Further, the housing is provided with a pair of locking means (locking levers 15) at both end portions thereof in its longitudinal direction. Each of the locking means is put on an axis (14) to be rotatable and has a horizontal portion (15*a*) operative to take a posture for extending to be parallel to the solid circuit board when any external force, such as pressure, does not act thereon and a slanted portion (15*b*) operative to take a posture for inclining to the solid circuit board when the external force, such as the pressure, does not act thereon. The horizontal portion (15*a*) and the slanted portion (15*b*) of the locking means are arranged to be rotatable in a body on the axis (14).

A top end of the slanted portion (15*b*) of the locking means is put in the opening (11) provided on the housing when any external force, such as pressure, does not act on the slanted portion (15*b*) of the locking means. Therefore, when the flat circuit device is inserted in the housing through the opening (11) provided thereon, first the slanted portion (15*b*) of the locking means is pushed by one of projections (22) provided on an end portion of the flat circuit device and thereby the locking means in its entirety is rotated in such a manner that the top end of the slanted portion (15*b*) of the locking means is pushed out of the opening (11).

Then, when the flat circuit device is further inserted in the housing so that the end portion of the flat circuit device reaches a predetermined correct position in the housing, the projection (22) provided on the end portion of the flat circuit device has passed a position corresponding to the top end of the slanted portion (15*b*) of the locking means and therefore the slanted portion (15*b*) of the locking means is released from a condition wherein the slanted portion (15*b*) of the locking means is pushed by the projection (22) of the flat circuit device. Accordingly, the locking means rotates to restore to the original state in such a manner that the top end of the slanted portion (15*b*) of the locking means is put in the opening (11) provided on the housing so that the horizontal portion (15*a*) of the locking means is caused to take the posture for extending to be parallel to the solid circuit board on which the housing is fixed and the slanted portion (15*b*) of the locking means is caused to take the posture for inclining to the solid circuit board.

Under the above-mentioned condition wherein the flat circuit device has been inserted in the housing through the opening (11) provided thereon, the top end of the slanted portion (15*b*) of the locking means, which is put in the opening (11), is caused to engage with a step portion (23) formed by the projection (22) of the flat circuit device. As a result, each of the locking means is operative to cause the top end of the slanted portions (15*b*) to engage with the step portion (23) formed by the projection (22) of the flat circuit device for holding the flat circuit device so as to prevent the same from getting out of the housing unwillingly when undesirable external force acts on the flat circuit device for drawing the same out of the housing.

In the electrical connector of the vertical insertion type thus proposed previously, which is provided with the locking means operative to prevent the flat circuit device inserted in the housing from getting out of the housing unwillingly, each of the locking levers (15) constituting the locking means is provided to be rotatable to the housing as an independent member separated from the housing and rotated in response to the inserting of the flat circuit device in the housing. Further, when occasion demands, a rib member for enforcing resiliently the locking lever (15) is also provided on the housing to ensure the rotation of the locking lever (15) in response to the inserting of the flat circuit device in the housing.

Accordingly, in the case of the above-mentioned previously proposed electrical connector of the vertical insertion type, there have been disadvantages that the number of constitutive parts of the electrical connector increases undesirably, a working process for assembling the electrical connector is undesirably complicated and a production cost of the electrical connector rises disagreeably.

OBJECTS AND SUMMARY OF THE INVENTION

Accordingly, it is an object of the present invention to provide an electrical connector of the vertical insertion type used for putting a flat circuit device, such as an FPC or FFC, in a condition of electrical connection with a solid circuit board, which comprises a housing provided to be mounted on the solid circuit board and having a pair of outer surface portions opposite to each other, one of which faces closely the solid circuit board and the other of which is provided thereon with an opening through which the flat circuit device is inserted into the housing along a direction substantially perpendicular to the solid circuit board, and a plurality of conductive contacts provided to be arranged on the housing for connecting electrically the flat circuit device with the solid circuit board, and which avoids the aforementioned disadvantages encountered with the prior art.

Another object of the present invention is to provide an electrical connector of the vertical insertion type used for putting a flat circuit device, such as an FPC or FFC, in a condition of electrical connection with a solid circuit board, which comprises a housing provided to be mounted on the solid circuit board and having a pair of outer surface portions opposite to each other, one of which is positioned to face closely the solid circuit board and the other of which is provided thereon with an opening through which the flat circuit device is inserted in the housing along a direction substantially perpendicular to the solid circuit board, and a plurality of conductive contacts provided to be arranged on the housing for connecting electrically the flat circuit device with the solid circuit board, and in which the flat circuit device inserted in the housing can be easily and surely put in holding to be prevented from getting out of the housing unwillingly and then released from the holding so as to be able to get out of the housing with a relatively small number of constitutive parts of the electrical connector resulting in a reduced production cost of the electronic connector.

A further object of the present invention is to provide an electrical connector of the vertical insertion type used for putting a flat circuit device, such as an FPC or FFC, in a condition of electrical connection with a solid circuit board, which comprises a housing provided to be mounted on the solid circuit board and having a pair of outer surface portions opposite to each other, one of which is positioned to face closely the solid circuit board and the other of which is provided thereon with an opening through which the flat circuit device is inserted in the housing along a direction substantially perpendicular to the solid circuit board, and a plurality of conductive contacts provided to be arranged on the housing for connecting electrically the flat circuit device with the solid circuit board, and in which the flat circuit device inserted in the housing can be easily and surely put in holding to be prevented from getting out of the housing unwillingly and then released from the holding so as to be able to get out of the housing with a structure assembled in a simplified working process resulting in a reduced production cost of the electronic connector.

A still further object of the present invention is to provide an electrical connector of the vertical insertion type used for putting a flat circuit device, such as an FPC or FFC, in a condition of electrical connection with a solid circuit board, which comprises a housing provided to be mounted on the solid circuit board and having a pair of outer surface portions opposite to each other, one of which is positioned to face closely the solid circuit board and the other of which is provided thereon with an opening through which the flat circuit device is inserted into the housing along a direction substantially perpendicular to the solid circuit board, and a plurality of conductive contacts provided to be arranged on the housing for connecting electrically the flat circuit device with the solid circuit board, and in which the flat circuit device inserted in the housing can be easily and surely put in holding to be prevented from getting out of the housing unwillingly and then released from the holding so as to be able to get out of the housing without a specific independent member separated from the housing provided to be rotatable in regard to the housing.

According to the present invention, there is provided an electrical connector, which comprises a housing provided to be mounted on a solid circuit board and having a first outer surface portion positioned to face closely the solid circuit board and a second outer surface portion opposite to the first outer surface portion and provided thereon with an opening through which a flat circuit device is inserted in the housing along a direction extending toward the first outer surface portion, a mounting member fixed to the housing for contributing to mounting the housing on the solid circuit board with an end portion positioned to face closely the solid circuit board, and a plurality of conductive contacts arranged on the housing to be electrically connected respectively with circuit terminals provided on the solid circuit board and positioned to come into contact respectively with connecting terminals provided on the flat circuit device inserted in the housing through the opening provided thereon, wherein the mounting member comprises a base portion positioned on the side of the first outer surface portion of the housing, a board connecting portion provided on the base portion to be connected with the solid circuit board, an arm portion extending from the base portion into the housing, a locking portion provided on the arm portion for engaging with the flat circuit device inserted in the housing through the opening provided thereon to hold the same, and a manipulatable portion provided on an end of the arm portion for protruding from the second outer surface portion of the housing to the outside of the housing, so as to be constituted in a body, and the locking portion is operative to be disengaged from engagement with the flat circuit device when the manipulatable portion is manipulated to shift in its position under a condition wherein the locking portion is put in the engagement with the flat circuit device.

Especially, in an example of the electronic connector according to the present invention, the locking portion of the mounting member forms an engaging projection protruding from the arm portion of the mounting member for engaging with an engaging edged portion provided on the flat circuit device inserted in the housing to hold the flat circuit device in the housing.

In the electrical connector thus constituted in accordance with the present invention, when the flat circuit device is inserted into the housing mounted on the solid circuit board with the first outer surface portion facing closely the same through the opening provided thereon along the direction extending toward the first outer surface portion, each of the conductive contacts provided to be arranged on the housing comes into contact with the corresponding one of the connecting terminals provided on the flat circuit device inserted in the housing and the locking portion provided on the arm portion of the mounting member engages with the flat circuit device inserted in the housing to hold the same. As a result, the flat circuit device inserted in the housing is prevented from getting out of the housing unwillingly.

Then, when the manipulatable portion provided on the end of the arm portion of the mounting member for protruding from the second outer surface portion of the housing to the outside of the housing is manipulated to shift in its position at the outside of the housing under the condition wherein the locking portion provided on the arm portion of the mounting member is put in engagement with the flat circuit device inserted in the housing, the arm portion on which the manipulatable portion is provided and the locking portion provided on the arm portion are moved in the housing so that the locking portion is released from the engagement with the flat circuit device. As a result, the flat circuit device inserted in the housing is put in a condition to be able to get out of the housing with the manipulation to the manipulatable portion of the mounting member for shifting the same in its position in the housing.

The locking portion of the mounting member employed, for example, in the example of the electrical connector as mentioned above, forms the engaging projection protruding from the arm portion of the mounting member. This engaging projection is operative to engage with the engaging edged portion provided on the flat circuit device inserted in the housing to hold the flat circuit device in the housing.

In the electrical connector thus constituted in accordance with the present invention, as described above, the locking portion which is operative to engage with the flat circuit device inserted in the housing to hold the same so that the flat circuit device inserted in the housing is prevented from getting out of the housing unwillingly and the manipulatable portion which is operative to cause the locking portion to disengage from the engagement with the flat circuit device so that the flat circuit device inserted in the housing is put in the condition to be able to get out of the housing, are formed in a body in the mounting member used for mounting the housing on the solid circuit board. The mounting member has the base portion positioned on the side of the first outer surface portion of the housing, the board connecting portion provided on the base portion, and the arm portion extending from the base portion into the housing, on which the locking portion and the manipulatable portion are provided. That is, the mounting member comprises the base portion, the board connecting portion, the arm portion, the locking portion and the manipulatable portion formed in a body therein.

As a result, with the electrical connector according to the present invention, the flat circuit device inserted in the housing can be easily and surely put in holding to be prevented from getting out of the housing unwillingly and then released from the holding so as to be able to get out of the housing with a relatively small number of constitutive parts of the electrical connector resulting in a reduced production cost of the electronic connector.

Further, with the electrical connector according to the present invention, the flat circuit device inserted in the housing can be easily and surely put in holding to be prevented from getting out of the housing unwillingly and then released from the holding so as to be able to get out of the housing with a structure assembled in a simplified working process resulting in a reduced production cost of the electronic connector.

Besides, with the electrical connector according to the present invention, the flat circuit device inserted in the housing can be easily and surely put in holding to be prevented from getting out of the housing unwillingly and then released from the holding so as to be able to get out of the housing without a specific independent member separated from the housing provided to be rotatable in regard to the housing.

Especially, in the example of the electrical connector according to the present invention, since the locking portion of the mounting member forms the engaging projection protruding from the arm portion of the mounting member for engaging with the engaging edged portion provided on the flat circuit device inserted in the housing to hold the flat circuit device in the housing, the flat circuit device inserted in the housing can be much more surely put in holding to be prevented from getting out of the housing unwillingly.

The above, and other objects, features and advantages of the present invention will become apparent from the following detailed description taken in conjunction with the accompanying drawings.

DESCRIPTION OF THE PREFERRED EMBODIMENT

Figure 1:
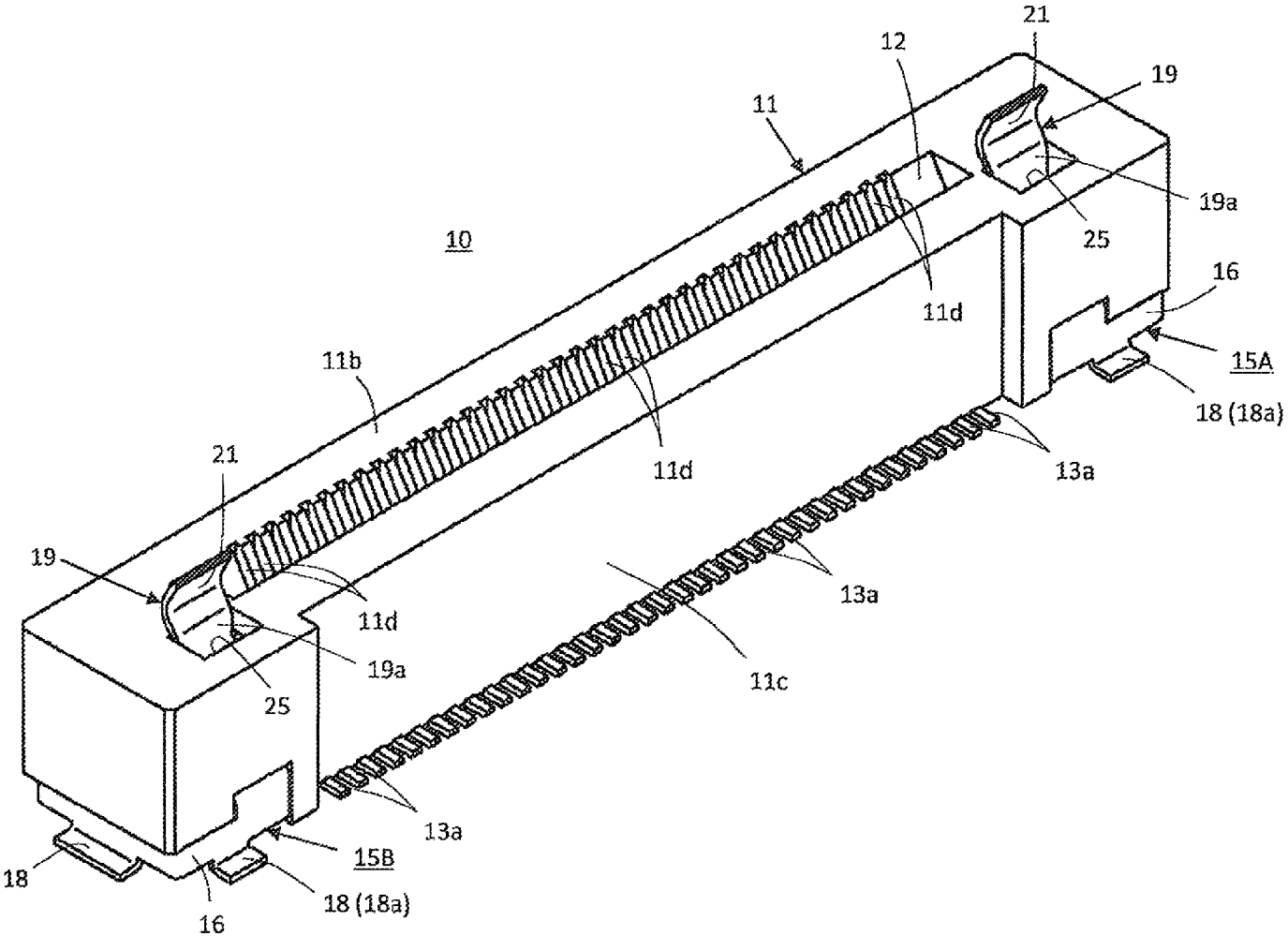
FIG. 1 is a schematic perspective view showing an embodiment of electrical connector according to the present invention.
Figure 2:
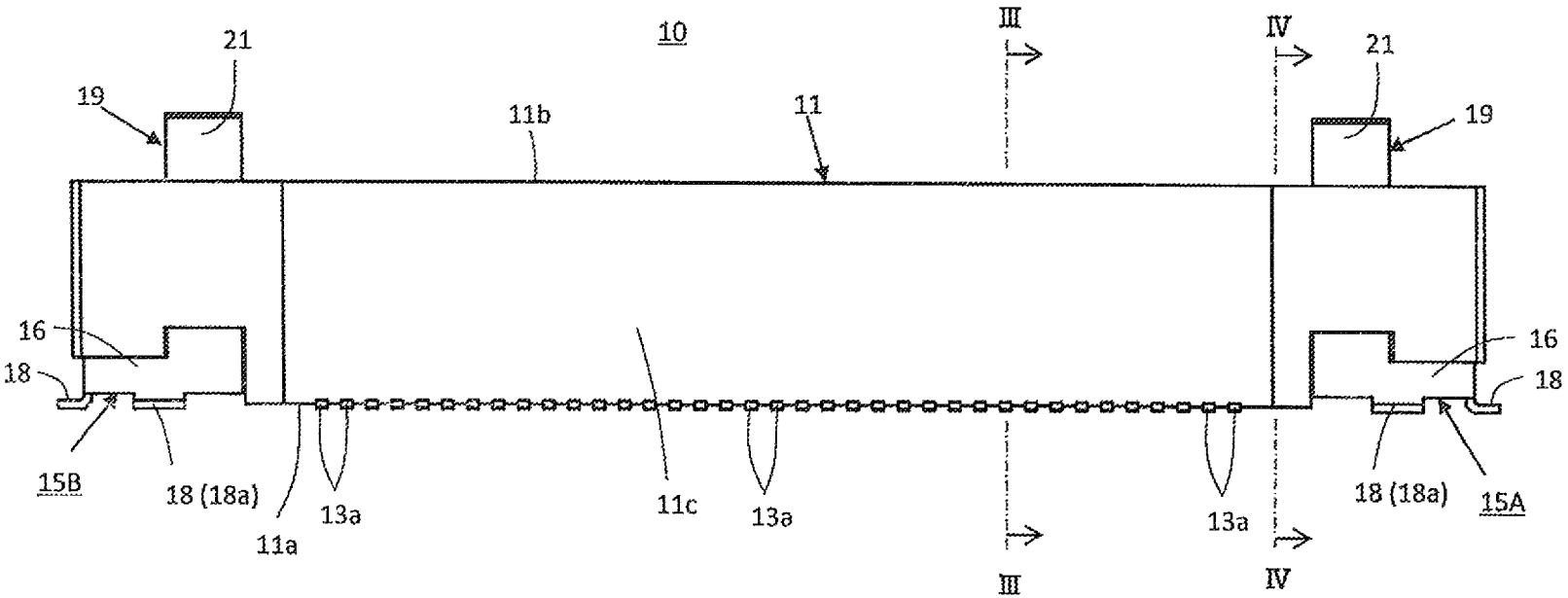
FIG. 2 is a schematic front view showing the embodiment shown in FIG. 1.
Figure 3:
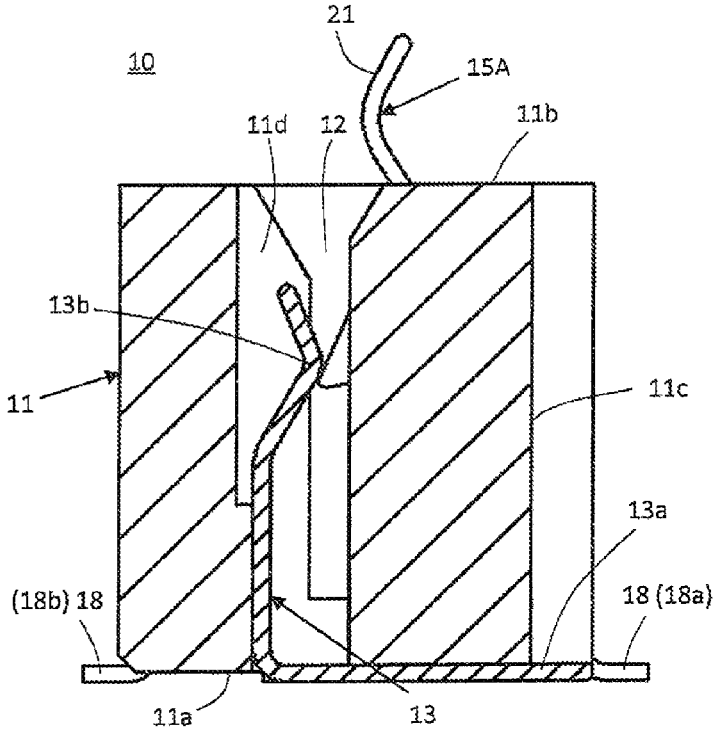
FIG. 3 is a schematic cross sectional view taken along line III-III on FIG. 2.
Figure 4:
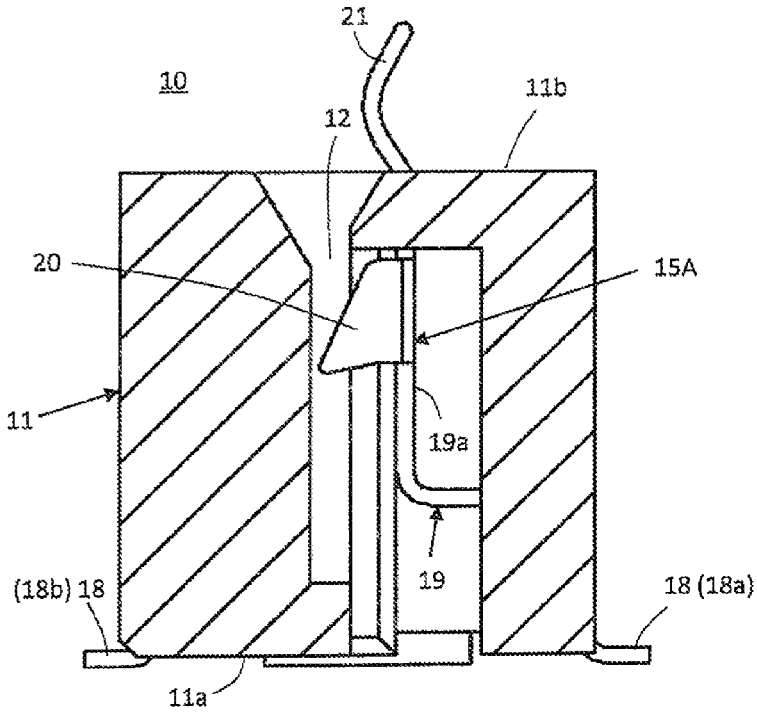
FIG. 4 is a schematic cross sectional view taken along line IV-IV on FIG. 2.

Each of FIG. 1 which is a schematic perspective view, FIG. 2 which is a schematic front view, FIG. 3 which is a schematic cross sectional view and FIG. 4 which is a schematic cross sectional view, shows an embodiment of electrical connector according to the present invention.

Referring to FIGS. 1 to 4, an electrical connector 10, which constitutes the embodiment of electrical connector according to the present invention, has a housing 11 made of insulator, such as plastics or the like, to be mounted on a solid circuit board (not shown in the drawings). The housing 11 has a first outer surface portion 11*a* positioned on the lower or bottom side of the housing 11 to face closely the solid circuit board on which the housing 11 is mounted and a second outer surface portion 11*b* positioned on the upper or top side of the housing 11 to be opposite to the first outer surface portion 11*a*.

The second outer surface portion 11*b* of the housing 11 is provided thereon with an opening 12 through which a flat circuit device, such as an FPC, is inserted into the housing 11. The opening 12 extends in a longitudinal direction of the housing 11, as shown in FIG. 1. Further, as shown in FIG. 3 which is a schematic cross sectional view taken along line III-III on FIG. 2 and in FIG. 4 which is a schematic cross sectional view taken along line IV-IV on FIG. 2, a part of the opening 12 forms a flat circuit board accommodating space which expands in the housing 11 from the second outer surface portion 11*b* of the housing 11 to the first outer surface portion 11*a* of the housing 11. The flat circuit board accommodating space thus expanding from the second outer surface portion 11*b* of the housing 11 to the first outer surface portion 11*a* of the housing 11 is formed to extend in a direction substantially perpendicular to the solid circuit board on which the housing 11 is mounted. Accordingly, the flat circuit device is inserted in the housing 11 through the opening 12 provided thereon along a direction extending toward the first outer surface portion 11*a* of the housing 11 to be substantially perpendicular to the solid circuit board on which the housing 11 is mounted. This means that the electrical connector 10 constitutes an electrical connector of the vertical insertion type.

A plurality of conductive contacts 13 are provided in the housing 11 to be arranged in the longitudinal direction of the housing 11, as shown in FIG. 3. An end of each of the conductive contacts 13 is positioned to project out of the housing 11 at a lower end of a front end portion 11*c* of the housing 11 so as to form a connecting terminal portion 13*a*. Each of the connecting terminal portions 13*a* is connected electrically, for example, by means of soldering, with a corresponding one of circuit terminals provided on the solid circuit board on which the housing 11 is mounted.

Each of the conductive contacts 13, which is made of resilient conductive material, extends from the connecting terminal portions 13*a* thereof into the housing 11 along the first outer surface portion 11*a* of the housing 11 and then bends to rise from the first outer surface portion 11*a* of the housing 11 into the flat circuit board accommodating space of the opening 12 and extend toward the second outer surface portion 11*b* of the housing 11, as shown in FIG. 3. A portion of the conductive contacts 13 positioned in the flat circuit board accommodating space of the opening 12 is provided with a press-contacting portion 13*b* for coming into press-contact with a corresponding one of connecting terminals provided on the flat circuit device, for example, the FPC, inserted in the housing 11 through the opening 12 provided thereon.

When the press-contacting portion 13*b* of each of the conductive contacts 13 is put in press-contact with the corresponding one of the connecting terminals provided on the flat circuit device inserted in the housing 11 through the opening 12 provided thereon, the connecting terminals provided on the flat circuit device are electrically connected through the conductive contacts 13 respectively with the circuit terminals provided on the solid circuit board on which the housing 11 is mounted. Thereby, the flat circuit device inserted in the housing 11 is put in a condition of electrical connection with the solid circuit board on which the housing 11 is mounted.

As shown in FIG. 1, a plurality of narrow grooves 11*d* are formed on an inner wall surface portion of the housing 11 constituting the opening 12 to be arranged in the longitudinal direction of the housing 11. In each of the narrow grooves 11*d* arranged in parallel with one another, the press-contacting portion 13*b* of each of the conductive contacts 13 is placed to be put in positional restriction. Although each of the conductive contacts 13 is provided to constitute a signal contact for coming into press-contact with the connecting terminal provided on the flat circuit device, it is also possible to use some of the conductive contacts 13 as grounding contacts for coming into press-contact with ground connecting terminals provided on the flat circuit device.

A couple of mounting members 15A and 15B are provided respectively on both end portions in the longitudinal direction of the housing 11 to be fixed thereto and used for mounting the housing 11 on the solid circuit board. Each of the mounting members 15A and 15B is formed with a resilient thin metal plate subjected to a punch and bend processing.

Figure 5:
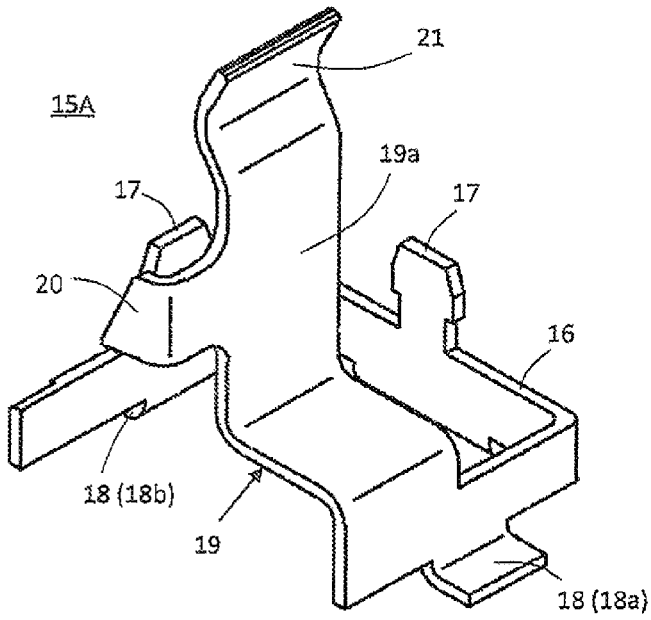
FIG. 5 is a schematic perspective view showing a mounting member provided to be employed in the embodiment shown in FIG. 1.
Figure 6:
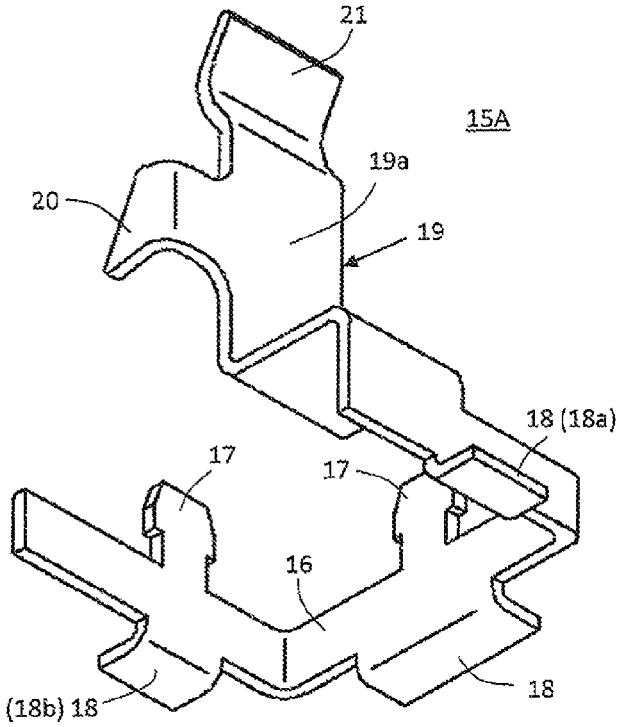
FIG. 6 is a schematic perspective view showing the mounting member provided to be employed in the embodiment shown in FIG. 1.

The mounting member 15A provided to be fixed to the end portions in the longitudinal direction of the housing 11 on the right side in FIG. 1 (hereinafter, referred to as a right end portion of the housing 11) has a base portion 16 which is to be positioned on the side of the first outer surface portion 11*a* of the housing 11, as shown in FIG. 5 which is a schematic perspective view, in FIG. 6 which is a schematic perspective view and in FIG. 7 which is a schematic front view. On the base portion 16, a plurality of engaging projections 17 are provided for engaging with the housing 11, a plurality of board connecting portions 18 are provided to be connected with the solid circuit board on which the housing 11 is mounted, and an arm portion 19 is provided to extend from the base portion 16 into the housing 11.

Each of the engaging projections 17 protrudes from the base portion 16 in a direction extending toward the second outer surface portion 11*b* of the housing 11 (an upward direction) and buried in the housing 11 from the outside of the first outer surface portion 11*a* of the housing 11 to engage therewith. Thereby, the mounting member 15A in its entirety is fixed to the right end portion of the housing 11.

Each of the board connecting portions 18 protrudes from the base portion 16 in a direction extending along the first outer surface portion 11*a* of the housing 11 and fixed to a housing mount portion provided on the solid circuit board, for example, by means of soldering to be connected with the solid circuit board. With the board connecting portions 18 of the mounting member 15A fixed to the right end portion of the housing 11 thus connected with the solid circuit board, the housing 11 in its entirety is mounted on the solid circuit board.

The arm portion 19 extends from the base portion 16 toward the inside of the housing 11 along the first outer surface portion 11*a* of the housing 11 and then bends to rise from the first outer surface portion 11*a* of the housing 11 and extend in the upward direction toward the second outer surface portion 11*b* of the housing 11. A part 19*a* of the arm portion 19 which extends in the upward direction toward the second outer surface portion 11*b* of the housing 11 is positioned between the board connecting portions 18*a* and 18*b* provided on the base portion 16 to be opposite to each other.

On the part 19*a* of the arm portion 19 thus positioned, a locking portion 20 is provided for engaging with the flat circuit device inserted in the housing 11 through the opening 12 provided thereon to hold the same. The locking portion 20 forms an engaging projection protruding from the part 19*a* of the arm portion 19 which is operative to engage with an engaging edged portion provided on the flat circuit device inserted in the housing 11 and thereby to hold the flat circuit device.

Further, a manipulatable portion 21 is also provided on an end of the part 19*a* of the arm portion 19. The manipulatable portion 21 is operative to cause the part 19*a* of the arm portion 19 to move, together with the locking portion 20 provided thereon, in a direction from the board connecting portion 18*b* to the board connecting portion 18*a* when manipulation is exerted on the manipulatable portion 21 to move the same resiliently in the direction from the board connecting portion 18*b* to the board connecting portion 18*a*. Then, after the part 19*a* of the arm portion 19 has been moved, together with the locking portion 20 provided thereon, in the direction from the board connecting portion 18*b* to the board connecting portion 18*a*, the part 19*a* of the arm portion 19 is moved by means of self resilience, together with the locking portion 20 provided thereon, in a direction from the board connecting portion 18*a* to the board connecting portion 18*b* so as to return to the former position when the manipulation on the manipulatable portion 21 is ceased.

As described above, the mounting member 15A comprises the base portion 16, the engaging projections 17, the board connecting portions 18, the arm portion 19, the locking portion 20 and the manipulatable portion 21, so as to be constituted in a body. That is, the mounting member 15A constitutes a single constructive member.

The mounting member 15B provided to be fixed to the end portions in the longitudinal direction of the housing 11 on the left side in FIG. 1 (hereinafter, referred to as a left end portion of the housing 11) is constituted in substantially the same manner as the mounting member 15B. To be concrete, the mounting member 15B comprises a base portion 16, a plurality of engaging projections 17, a plurality of board connecting portions 18, an arm portion 19, a locking portion 20 and a manipulatable portion 21, so as to be constituted in a body. That is, the mounting member 15B constitutes also a single constructive member. (The engaging projections 17 and the locking portion 20 of the mounting member 15B do not appear on the drawings.) Each of the base portion 16, the engaging projections 17, the board connecting portions 18, the arm portion 19, the locking portion 20 and the manipulatable portion 21 of the mounting member 15B is operative to function in the same manner as each of those of the mounting member 15A explained above.

Figure 7:
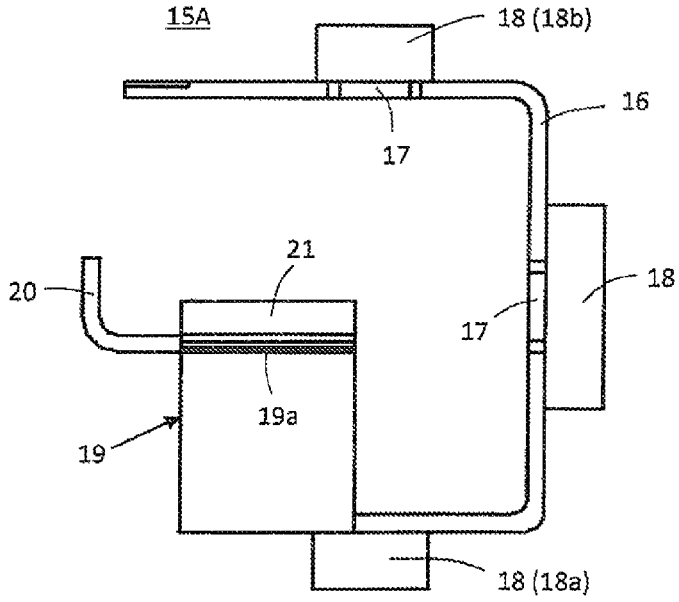
FIG. 7 is a schematic plane view showing the mounting member provided to be employed in the embodiment shown in FIG. 1.

To explain a positional relation between the board connecting portions 18 each provided on the base portion 16 and the manipulatable portion 21 provided on the end of the part 19*a* of the arm portion 19 in detail, as shown in FIG. 7, the manipulatable portion 21 is so positioned that at least a part of the manipulatable portion 21 is put in a space between the board connecting portions 18 opposite to each other. With the manipulatable portion 21 thus positioned, each of the board connecting portions 18, which are fixed to the solid circuit board, for example, by means of soldering, is prevented from being destructively removed from the solid circuit board when the manipulatable portion 21 is manipulated to cause the part 19*a* of the arm portion 19 to move resiliently in the direction from the board connecting portion 18*b* to the board connecting portion 18*a*.

Figure 8:
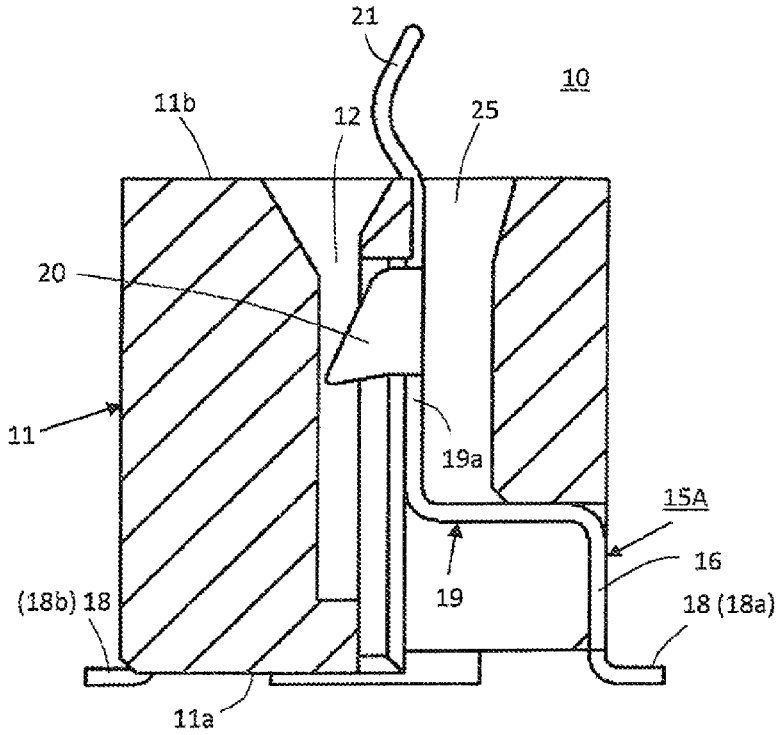
FIG. 8 is a schematic cross sectional view showing a positional relation between a locking portion and a manipulatable portion formed in the mounting member employed in the embodiment shown in FIG. 1.
Figure 9:
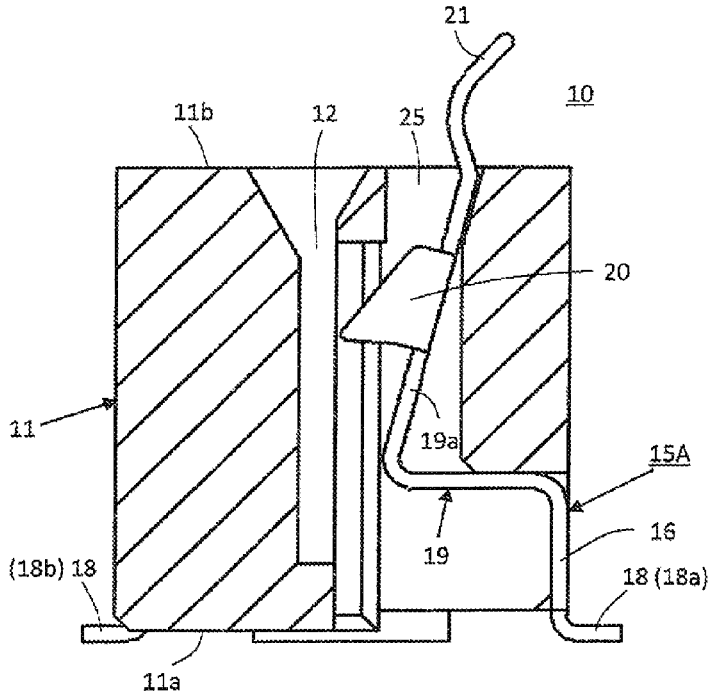
FIG. 9 is a schematic cross sectional view showing a positional relation between a locking portion and a manipulatable portion formed in the mounting member employed in the embodiment shown in FIG. 1.

Under a condition wherein the mounting member 15A is fixed to the right end portion of the housing 11, as shown in FIG. 8 and FIG. 9, the arm portion 19 of the mounting member 15A is put in an inner space formed in the housing 11 and the manipulatable portion 21 provided on the end of the part 19*a* of the arm portion 19 projects from the second outer surface portion 11*b* of the housing 11 to the outside of the housing 11 through an opening 25 provided on the second outer surface portion 11*b* of the housing 11.

When the manipulatable portion 21 is not manipulated, the part 19*a* of the arm portion 19 is so positioned as to be shown in FIG. 8 and a top end part of the locking portion 20 provided on the part 19*a* of the arm portion 19 is put in the flat circuit board accommodating space of the opening 12. On the other hand, when the manipulatable portion 21 is manipulated to cause the part 19*a* of the arm portion 19 to move resiliently, together with the locking portion 20 provided thereon, in the direction from the board connecting portion 18*b* to the board connecting portion 18*a*, the part 19*a* of the arm portion 19 is so positioned as to be shown in FIG. 9 and the whole of the locking portion 20 provided on the part 19*a* of the arm portion 19 is moved out of the flat circuit board accommodating space of the opening 12. After that, the part 19*a* of the arm portion 19 is moved by means of self resilience, together with the locking portion 20, to return to the position shown in FIG. 8.

Although illustrations are omitted, in the mounting member 15B fixed to the left end portion of the housing 11, the arm portion 19 is put in the inner space formed in the housing 11 and the manipulatable portion 21 provided on the end of the part 19*a* of the arm portion 19 projects from the second outer surface portion 11*b* of the housing 11 to the outside of the housing 11 through the opening 25 provided on the second outer surface portion 11*b* of the housing 11. Under such a situation, when the manipulatable portion 21 is not manipulated, a top end part of the locking portion 20 provided on the part 19*a* of the arm portion 19 is put in the flat circuit board accommodating space of the opening 12. On the other hand, when the manipulatable portion 21 is manipulated to cause the part 19*a* of the arm portion 19 to move resiliently, together with the locking portion 20 provided thereon, in the direction from the board connecting portion 18*b* to the board connecting portion 18*a*, the whole of the locking portion 20 provided on the part 19*a* of the arm portion 19 is moved out of the flat circuit board accommodating space of the opening 12. After that, the part 19*a* of the arm portion 19 is moved by means of self resilience, together with the locking portion 20, to return to the former position.

Figure 10:
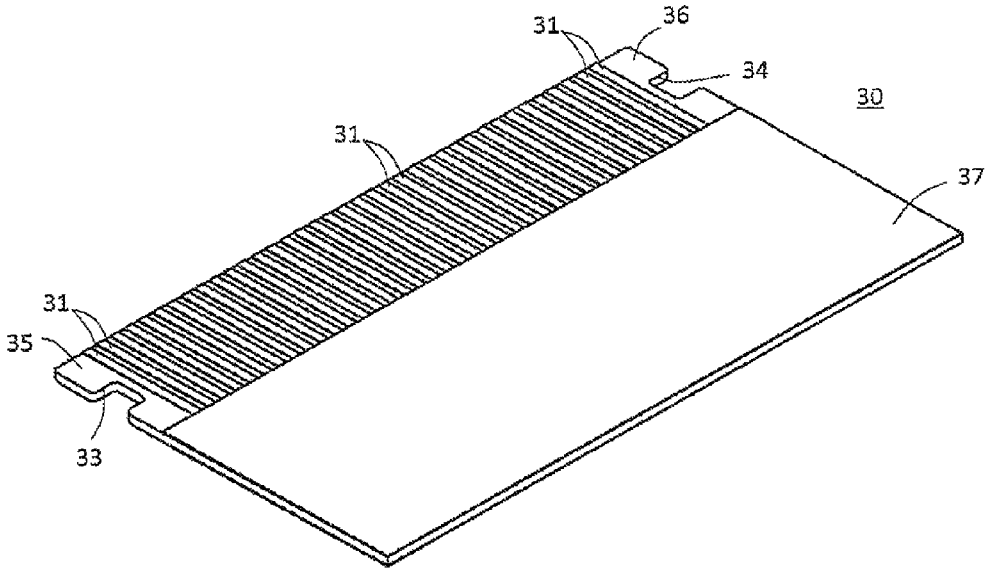
FIG. 10 is a schematic perspective view showing an FPC which is to be inserted into a housing of the embodiment shown in FIG. 1.

FIG. 10 shows an FPC 30 which constitutes the flat circuit device to be inserted into the housing 11 of the electrical connector 10 through the opening 12 provided on the housing 11.

Referring to FIG. 10, the FPC 30 is provided with a plurality of connecting terminals 31 each made of conductive material to be formed into a rectangular plate member and arranged on an end portion of one of a pair of plane surfaces opposite to each other. The end portion of the plane surface on which the connecting terminals 31 is provided to be arranged constitutes an end portion of the FPC 30.

Further, a pair of engaging edged recesses 33 and 34 are provided respectively on side end portions of the FPC 30. The engaging edged recesses 33 and 34 are opposite to each other with the connecting terminals 31 provided to be arranged on the end portion of the FPC 30 between. A top flat portion 35 is formed at the outside of the engaging edged recess 33 provided on one of the side end portions of the FPC 30 and another top flat portion 36 is formed at the outside of the engaging edged recess 34 provided on the other of the side end portions of the FPC 30.

It is possible to provide the FPC 30 with a pair of engaging edged holes formed respectively on the side end portions of the FPC 30 in place of the engaging edged recesses 33 and 34.

In the FPC 30 thus constituted, the plane surface, on the end portion of which the connecting terminals 31 are provided to be arranged, covered with an insulating film 37 except portions thereof on which the connecting terminals 31 are arranged and in which the engaging edged recesses 33 and 34 and the top flat portions 35 and 36 are formed.

Figure 11:
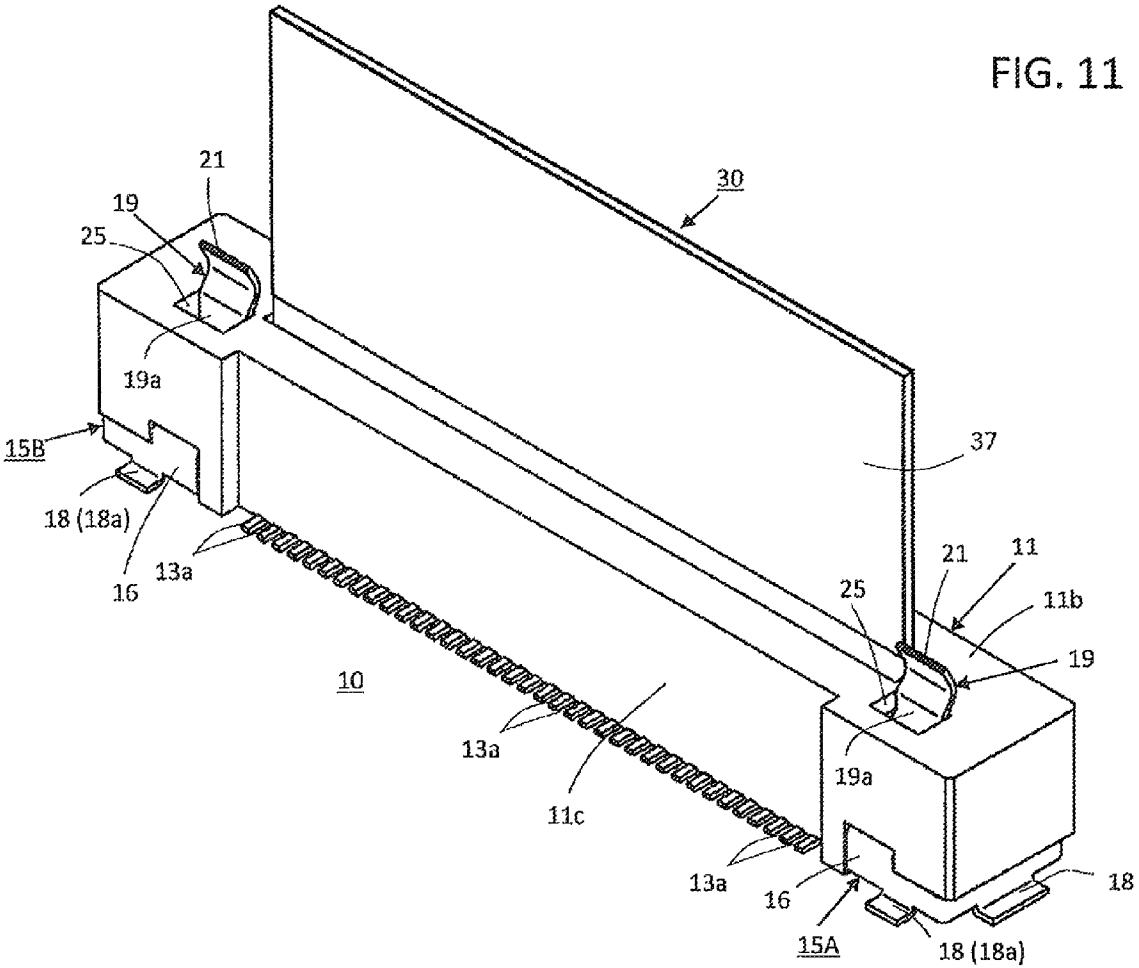
FIG. 11 is a schematic perspective view showing the embodiment shown in FIG. 1 and the FPC which is inserted in the housing of the embodiment shown in FIG. 1.

FIG. 11 shows the electrical connector 10 and the FPC 30 which is inserted in the housing 11 of the electrical connector 10 through the opening 12 provided on the housing 11. In FIG. 11, the plane surface of the FPC 30 covered with the insulating film 37, which is opposite to another plane surface of the FPC 30, on which the connecting terminals 31 are provided to be arranged at the end portion thereof and which is covered also with the insulating film 37, is positioned to face a front end portion 11*c* of the housing 11. In a condition wherein the FPC 30 is thus inserted into the housing 11 of the electrical connector 10 through the opening 12 provided on the housing 11, the press-contacting portion 13*b* of each of the conductive contacts 13 comes into press-contact with the corresponding one of the connecting terminals 31 provided on the FPC 30. Thereby, the connecting terminals 31 provided on the FPC 30 are electrically connected respectively with the circuit terminals provided on the solid circuit board on which the housing 11 is mounted through the conductive contacts 13 in the electrical connector 10.

When the FPC 30 is inserted in the housing 11 of the electrical connector 10 through the opening 12 provided on the housing 11, as shown in FIG. 11, prior to the insertion of the FPC 30 in the housing 11, the electrical connector 10 is prepared in such a manner that the arm portion 19 of the mounting member 15A fixed to the right end portion of the housing 11, on which the locking portion 20 and the manipulatable portion 21 are provided, is so positioned as to be shown in FIG. 8 and the arm portion 19 of the mounting member 15B fixed to the left end portion of the housing 11, on which the locking portion 20 and the manipulatable portion 21 are provided, is also positioned in the same manner as the arm portion 19 of the mounting member 15A.

Figure 12:
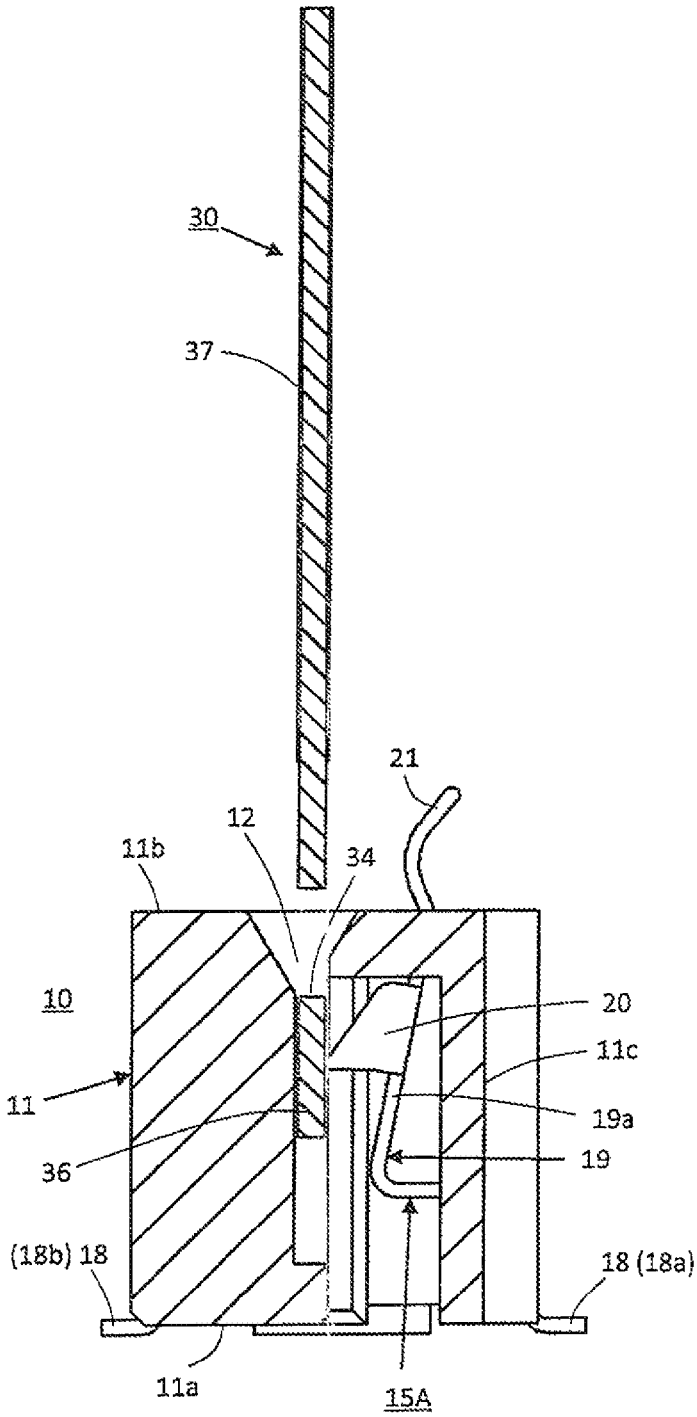
FIG. 12 is a schematic cross sectional view showing the embodiment shown in FIG. 1 and the FPC which is put on the way to be inserted into the housing of the embodiment shown in FIG. 1.

Then, the FPC 30 is inserted in the housing 11 of the electrical connector 10 through the opening 12 provided on the housing 11 along the direction extending toward the first outer surface portion 11*a* of the housing 11, which is substantially perpendicular to the solid circuit board on which the housing 11 is mounted. On that occasion, in the right end portion of the housing 11 to which the mounting member 15A is fixed, the locking portion 20 of the mounting member 15A, the top end part of which is put in the flat circuit device accommodating space of the opening 12 in the housing 11, is pushed by the top flat portion 36 formed at the outside of the engaging edged recess 34 provided on the FPC 30 to move so that the whole of the locking portion 20 is moved out of the flat circuit board accommodating space of the opening 12, as shown in FIG. 12. Similarly, in the left end portion of the housing 11 to which the mounting member 15B is fixed, the locking portion 20 of the mounting member 15B, the top end part of which is put in the flat circuit device accommodating space of the opening 12 in the housing 11, is pushed by the top flat portion 35 formed at the outside of the engaging edged recess 33 provided on the FPC 30 to move resiliently so that the whole of the locking portion 20 is moved out of the flat circuit board accommodating space of the opening 12, as shown in FIG. 12. The locking portion 20 of the mounting member 15A is put in a condition wherein only the top end part thereof comes into contact with the top flat portion 36 of the FPC 30 and the locking portion 20 of the mounting member 15B is put in a condition wherein only the top end part thereof comes into contact with the top flat portion 35 of the FPC 30. Therefore, the locking portion 20 of each of the mounting members 15A and 15B does not disturb a further insertion of the FPC 30 in the housing 11.

In addition, the manipulatable portion 21 of the mounting member 15A projecting from the second outer surface portion 11*b* of the housing 11 to the outside of the housing 11 through the opening 25 provided on the second outer surface portion 11*b* is positioned to be remote from the FPC 30 inserted in the housing 11, as shown in FIG. 2. Although illustrations are omitted, the manipulatable portion 21 of the mounting member 15B projecting from the second outer surface portion 11*b* of the housing 11 to the outside of the housing 11 through the opening 25 provided on the second outer surface portion 11*b* is also positioned to be remote from the FPC 30 inserted in the housing 11 in the same manner as the manipulatable portion 21 of the mounting member 15A.

Figure 13:
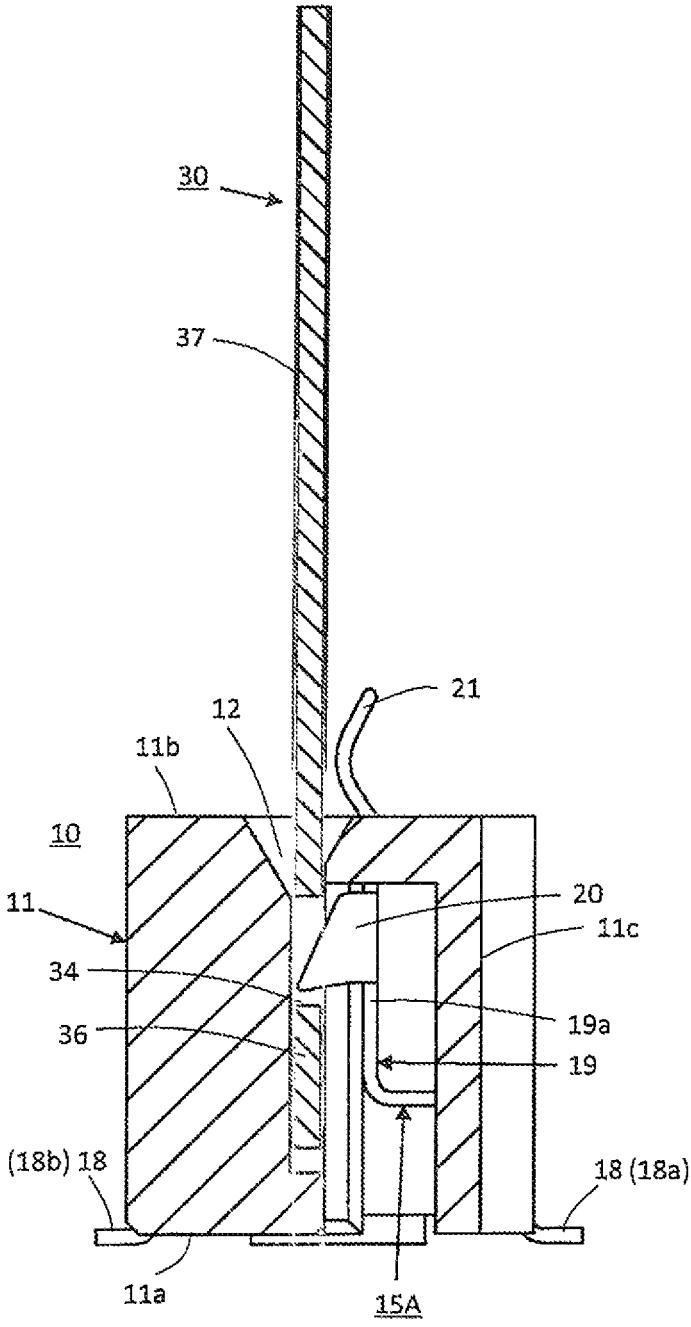
FIG. 13 is a schematic cross sectional view showing the embodiment shown in FIG. 1 and the FPC which has been inserted in the housing and held by the locking portion of the mounting member employed in the embodiment shown in FIG. 1.

After that, the FPC 30 is still further inserted in the housing 11 through the opening 12 provided thereon to reach a predetermined appropriate position in the housing 11. When the FPC 30 has reached the predetermined appropriate position in the housing 11, in the right end portion of the housing 11 to which the mounting member 15A is fixed, the locking portion 20 of the mounting member 15A is put out of the top flat portion 36 formed on the FPC 30, as shown in FIG. 13. Thereby, the part 19*a* of the arm portion 19 on which the locking portion 20 is provided is shifted in position to be restored by means of self resilience so that the top end part of the locking portion 20 returns to the position in the flat circuit device accommodating space of the opening 12.

The locking portion 20 of the mounting member 15A having the top end part thereof put in the flat circuit device accommodating space of the opening 12 comes to engagement with the engaging edged recess 34 provided on the FPC 30 to hold the FPC 30.

Further, on that occasion, although illustrations are omitted, in the left end portion of the housing 11 to which the mounting member 15B is fixed, the locking portion 20 of the mounting member 15B is put out of the top flat portion 35 formed on the FPC 30. Thereby, the part 19*a* of the arm portion 19 on which the locking portion 20 is provided is shifted in position to be restored by means of self resilience so that the top end part of the locking portion 20 returns to the position in the flat circuit device accommodating space of the opening 12.

The locking portion 20 of the mounting member 15B having the top end part thereof put in the flat circuit device accommodating space of the opening 12 comes to engagement with the engaging edged recess 33 provided on the FPC 30 to hold the FPC 30.

As a result, the FPC 30 has been completely inserted in the housing 11 to be placed at the predetermined appropriate position in the housing 11 and held by the locking portion 20 of each of the mounting members 15A and 15B to be prevented from getting out of the housing 11 unwillingly. That is, the FPC 30 is automatically held by the locking portion 20 of each of the mounting members 15A and 15B so as to be put in a condition to be prevented from getting out from the housing 11 unwillingly only by means of being merely inserted into the housing 11.

When the FPC 30 inserted in the housing 11 has reached the predetermined appropriate position in the housing 11, the manipulatable portion 21 of the mounting member 15A projecting from the second outer surface portion 11*b* of the housing 11 to the outside of the housing 11 through the opening 25 provided on the second outer surface portion 11*b* is positioned to be close to the FPC 30 inserted in the housing 11, as shown in FIG. 13, and the manipulatable portion 21 of the mounting member 15B projecting from the second outer surface portion 11*b* of the housing 11 to the outside of the housing 11 through the opening 25 provided on the second outer surface portion 11*b* is also positioned to be close to the FPC 30 inserted in the housing 11 in the same manner as the manipulatable portion 21 of the mounting member 15A.

Further, some of the conductive contacts 13, which are not shown in FIG. 13 but positioned to be near to each of the engaging edged recesses 33 and 34 provided on the FPC 30, are operative to push resiliently the FPC 30 toward the locking portion 20 of each of the mounting members 15A and 15B, so that the FPC 30 is held more surely and stably by the locking portion 20 of each of the mounting members 15A and 15B.

Figure 14:
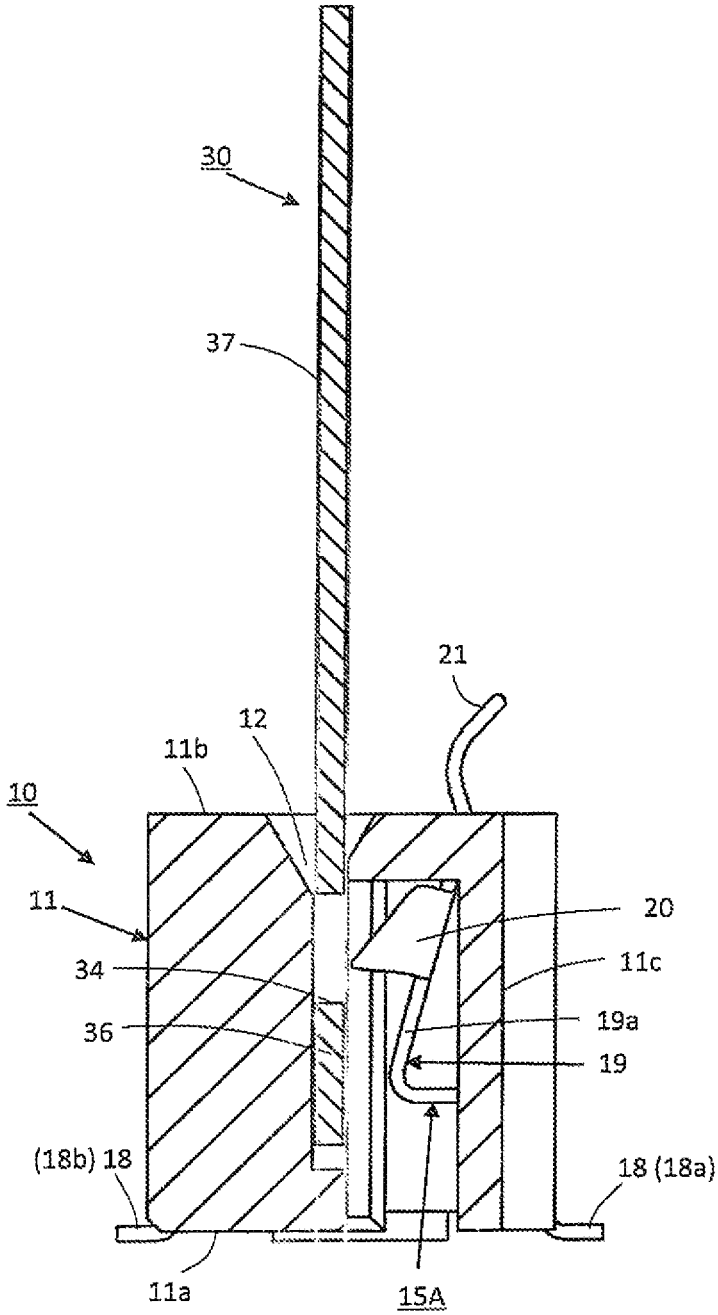
FIG. 14 is a schematic cross sectional view showing the embodiment shown in FIG. 1 and the FPC which has been inserted in the housing and released from holding by the locking portion of the mounting member employed in the embodiment shown in FIG. 1

After that, when the manipulatable portion 21 of the mounting member 15A fixed to the right end portion of the housing 11, which projects from the second outer surface portion 11*b* of the housing 11 to the outside of the housing 11 through the opening 25 provided on the second outer surface portion 11*b* of the housing 11, is manipulated to go away from the FPC 30 inserted in the housing 11 so as to cause the part 19*a* of the arm portion 19 to move resiliently, together with the locking portion 20 provided thereon, in the direction from the board connecting portion 18*b* to the board connecting portion 18*a*, the locking portion 20 is so positioned that the whole of the locking portion 20 is moved out of the flat circuit board accommodating space of the opening 12 in the housing 11, as shown in FIG. 14. Therefore, the locking portion 20 of the mounting member 15A is disengaged from the engagement with the engaging edged recess 34 provided on the FPC 30 inserted in the housing 11 so that the FPC 30 is released from holding by the locking portion 20.

Similarly, although illustrations are omitted, when the manipulatable portion 21 of the mounting member 15B fixed to the left end portion of the housing 11, which projects from the second outer surface portion 11*b* of the housing 11 to the outside of the housing 11 through the opening 25 provided on the second outer surface portion 11*b* of the housing 11, is manipulated to go away from the FPC 30 inserted in the housing 11 so as to cause the part 19*a* of the arm portion 19 to move resiliently, together with the locking portion 20 provided thereon, in the direction from the board connecting portion 18*b* to the board connecting portion 18*a*, the locking portion 20 is so positioned that the whole of the locking portion 20 is moved out of the flat circuit board accommodating space of the opening 12 in the housing 11, as shown in FIG. 14. Therefore, the locking portion 20 of the mounting member 15B is disengaged from the engagement with the engaging edged recess 33 provided on the FPC 30 inserted in the housing 11 so that the FPC 30 is released from holding by the locking portion 20.

As a result, the FPC 30 inserted in the housing 11 is put in a condition to be able to get out of the housing 11 appropriately.

As described above, since the part 19*a* of the arm portion 19 of each of the mounting members 15A and 15B, on the top end of which the manipulatable portion 21 is provided, is positioned between the board connecting portions 18*a* and 18*b* extending from the base portion 16 of each of the mounting members 15A and 15B so as to be opposite to each other and to be connected with the solid circuit board, for example, by means of soldering, the arm portion 19 of each of the mounting members 15A and 15B is operative to support the manipulatable portion 21 which is manipulated to go away from the FPC 30 inserted in the housing 11 with a stabilized structure and prevented from being undesirably deformed or damaged.

Then, when the manipulation on the manipulatable portion 21 for causing the part 19*a* of the arm portion 19 to move resiliently, together with the locking portion 20 provided thereon, in the direction from the board connecting portion 18*b* to the board connecting portion 18*a* is ceased, the part 19*a* of the arm portion 19 of each of the mounting members 15A and 15B is moved by means of self resilience, together with the locking portion 20 provided thereon, in the direction from the board connecting portion 18*a* to the board connecting portion 18*b* so as to return to the former position so that the top end part of the locking portion 20 returns to the position in the flat circuit device accommodating space of the opening 12 in the housing 11.

Although the electrical connector 10, which constitutes the embodiment of electrical connector according to the present invention, is not provided with any conductive shell for covering the outer surfaces of the housing 11, it is also possible to provide the electrical connector according to the present invention with a conductive shell for covering partially or entirely outer surfaces of the electrical connector. In such a case, it is desired to put the conductive shell in a grounded condition.

In the electrical connector 10 provided with the housing 11 which is mounted on the solid circuit board with the first outer surface portion 11*a* positioned to face closely the solid circuit board and the second outer surface portion 11*b* positioned to be opposite to the first outer surface portion 11*a* and in which the FPC 30 is inserted through the opening 12 provided on the second outer surface portion 11*b*, the locking portion 20 which is operative to engage with the FPC 30 inserted in the housing 11 to hold the same so that the FPC 30 inserted in the housing 11 is prevented from getting out of the housing 11 unwillingly and the manipulatable portion 21 which is operative to cause the locking portion 20 to disengage from the engagement with the FPC 30 so that the FPC 30 inserted in the housing 11 is put in the condition to be able to get out of the housing 11, are formed in a body in each of the mounting members 15A and 15B used for mounting the housing 11 on the solid circuit board. Each of the mounting members 15A and 15B has the base portion 16 positioned on the side of the first outer surface portion 11*a* of the housing 11, the engaging projections 17 protruding from the base portion 16 to be buried in the housing 11, the board connecting portions 18 provided on the base portion 16 to be connected with the solid circuit board, and the arm portion 19 extending from the base portion 16 into the housing 11, on which the locking portion 20 and the manipulatable portion 21 are provided. That is, each of the mounting members 15A and 15B comprises the base portion 16, the engaging projections 17, the board connecting portion 18, the arm portion 19, the locking portion 20 and the manipulatable portion 21 formed in a body therein.

As a result, with the electrical connector 10, the FPC 30 inserted in the housing 11 can be easily and surely put in the holding by the locking portions 20 to be prevented from getting out of the housing 11 unwillingly and then released from the holding by the locking portions 20 so as to be able to get out of the housing 11 with a relatively small number of constitutive parts of the electrical connector 10 and without a specific independent member separated from the housing 11 provided to be rotatable in regard to the housing 11. This results in a reduced production cost of the electrical connector 10.

Further, with the electrical connector 10, the FPC 30 inserted in the housing 11 can be easily and surely put in the holding by the locking portions 20 to be prevented from getting out of the housing 11 unwillingly and then released from the holding by the locking portions 20 so as to be able to get out of the housing 11 with a structure assembled in a simplified working process resulting also in a reduced production cost of the electrical connector 10.

Besides, in the electrical connector 10, when the FPC 30 inserted in the housing 11 has reached the predetermined appropriate position in the housing 11 so as to be appropriately held by the locking portion 20 of each of the mounting members 15A and 15B, the manipulatable portion 21 of each of the mounting members 15A and 15B is positioned to be close to the FPC 30 inserted in the housing 11, and when the FPC 30 inserted in the housing 11 has not reached the predetermined appropriate position in the housing 11 so as not to be appropriately held by the locking portion 20 of each of the mounting members 15A and 15B, the manipulatable portion 21 of each of the mounting members 15A and 15B is positioned to be remote from the FPC 30 inserted in the housing 11.

The manipulatable portion 21 positioned to be close to the FPC 30 inserted in the housing 11 is easily and accurately distinguished from the manipulatable portion 21 positioned to be remote from the FPC 30 inserted in the housing 11 by means of visual observation from the outside of the housing 11. Accordingly, a condition wherein the FPC 30 is appropriately held by the locking portion 20 of each of the mounting members 15A and 15B in the housing 11 can be easily and accurately ascertained by means of visual observation to the manipulatable portion 21 projecting from the second outer surface portion 11*b* of the housing 11 to the outside of the housing 11.

What is claimed is:

1. An electrical connector comprising:

a housing provided to be mounted on a solid circuit board and having a first outer surface portion positioned to face closely the solid circuit board and a second outer surface portion opposite to the first outer surface portion and provided thereon with an opening through which a flat circuit device is inserted in the housing along a direction extending toward the first outer surface portion, a mounting member fixed to the housing for contributing to mounting the housing on the solid circuit board with an end portion positioned to face closely the solid circuit board, and a plurality of conductive contacts arranged on the housing to be electrically connected respectively with circuit terminals provided on the solid circuit board and positioned to come into contact respectively with connecting terminals provided on the flat circuit device inserted in the housing through the opening provided thereon, wherein said mounting member includes a base portion positioned on the side of the first outer surface portion of the housing, a plurality of board connecting portions provided on the base portion to be connected with the solid circuit board, an arm portion extending from the base portion into the housing, a locking portion provided on the arm portion for engaging with the flat circuit device inserted in the housing through the opening provided thereon to hold the same, and a manipulatable portion provided on an end of the arm portion for protruding from the second outer surface portion of the housing to the outside of the housing, said manipulatable portion is so positioned as to be put in a space between two of the board connecting portions opposite to each other, and said locking portion is operative to be disengaged from engagement with the flat circuit device when the manipulatable portion is manipulated to shift in its position under a condition wherein the locking portion is put in the engagement with the flat circuit device.

2. The electrical connector according to claim 1, wherein said arm portion extends from the base portion of the mounting member toward the inside of the housing along the first outer surface portion of the housing and then bends to rise from the first outer surface portion of the housing and extend toward the second outer surface portion of the housing.

3. The electrical connector according to claim 1, wherein said locking portion of the mounting member forms an engaging projection protruding from the arm portion of the mounting member for engaging with an engaging edged portion provided on the flat circuit device inserted in the housing to hold the flat circuit device in the housing.

* * * * *